US009033433B2

(12) United States Patent
Breisacher et al.

(10) Patent No.: US 9,033,433 B2
(45) Date of Patent: May 19, 2015

(54) PULL-OUT GUIDE FOR DRAWERS

(75) Inventors: Andreas Breisacher, Endingen (DE); Heimo Weber, Gundelfingen (DE)

(73) Assignee: ANTON SCHNEIDER GMBH & CO. KG, Kenzingen (DE)

( * ) Notice: Subject to any disclaimer, the term of this patent is extended or adjusted under 35 U.S.C. 154(b) by 0 days.

(21) Appl. No.: 13/810,078

(22) PCT Filed: Mar. 18, 2011

(86) PCT No.: PCT/EP2011/054134

§ 371 (c)(1),
(2), (4) Date: Jan. 30, 2013

(87) PCT Pub. No.: WO2012/007189

PCT Pub. Date: Jan. 19, 2012

(65) Prior Publication Data

US 2013/0119843 A1 May 16, 2013

(30) Foreign Application Priority Data

Jul. 14, 2010 (DE) ..... 20 2010 008 079 U

(51) Int. Cl.
*A47B 95/00* (2006.01)
*A47B 88/04* (2006.01)
*A47B 88/08* (2006.01)

(52) U.S. Cl.
CPC ..... *A47B 88/047* (2013.01); *A47B 88/08* (2013.01); *A47B 2210/0094* (2013.01)

(58) Field of Classification Search
CPC ..... A47B 88/047; A47B 88/0474; A47B 88/0481; A47B 88/08; A47B 2210/0016; A47B 2210/0056; A47B 2210/0059; A47B 2210/0094
USPC ..... 312/333, 319.1–319.2, 334.6–334.8; 384/21
See application file for complete search history.

(56) References Cited

U.S. PATENT DOCUMENTS

| | | | | |
|---|---|---|---|---|
| 5,207,781 | A * | 5/1993 | Rock | 312/319.1 |
| 5,474,375 | A | 12/1995 | Hollenstein et al. | |
| 5,580,138 | A * | 12/1996 | Grabher | 312/319.1 |
| 6,340,078 | B1 * | 1/2002 | Scheible | 188/166 |
| 7,040,725 | B1 | 5/2006 | Mao-Chin | |
| 7,249,813 | B2 | 7/2007 | Gasser | |
| 7,374,260 | B2 * | 5/2008 | Lu | 312/333 |
| 7,399,041 | B2 * | 7/2008 | Prentner et al. | 312/333 |

(Continued)

FOREIGN PATENT DOCUMENTS

| | | | |
|---|---|---|---|
| AT | 503045 | A1 | 7/2007 |
| DE | 9114787 | A | 2/1992 |

(Continued)

*Primary Examiner* — Hanh V Tran
(74) *Attorney, Agent, or Firm* — Lucas & Mercanti, LLP; Klaus P. Stoffel

(57) ABSTRACT

A pull-out guide for drawers or the like, includes a body rail, a drawer rail, and an automatic retraction for retracting the drawer rail into its closed final position. The automatic retraction is fixed to the body rail or drawer rail and has a pivotable coupling element that is guided in a longitudinally displaceable manner and interacts with a catch which is provided on the respective other rail. The automatic retraction and the catch are arranged in a vertical intermediate space, which is formed between a horizontal web of the body rail and a horizontal web of the drawer rail. The automatic retraction housing abuts the horizontal web of that rail to which the automatic retraction is fixed, and the coupling element can be pivoted about a horizontal axis into a locked position.

8 Claims, 3 Drawing Sheets

(56) References Cited

U.S. PATENT DOCUMENTS

| | | | | |
|---|---|---|---|---|
| 7,731,311 | B2 * | 6/2010 | Lam et al. | 312/333 |
| 8,182,054 | B2 * | 5/2012 | Liang et al. | 312/333 |
| 8,240,788 | B2 * | 8/2012 | Juan et al. | 312/333 |
| 2004/0000850 | A1 * | 1/2004 | Lam Harn et al. | 312/333 |
| 2004/0212283 | A1 * | 10/2004 | Gasser | 312/333 |
| 2006/0175946 | A1 * | 8/2006 | Le | 312/333 |
| 2006/0238089 | A1 * | 10/2006 | Prentner et al. | 312/333 |
| 2007/0046158 | A1 * | 3/2007 | Hoffman | 312/333 |
| 2007/0101539 | A1 | 5/2007 | Sutterlutti et al. | |
| 2007/0103041 | A1 * | 5/2007 | Kropf et al. | 312/333 |
| 2007/0114896 | A1 * | 5/2007 | Orita | 312/334.14 |
| 2007/0188060 | A1 * | 8/2007 | Nussbaumer et al. | 312/333 |
| 2007/0278919 | A1 * | 12/2007 | Lu | 312/333 |
| 2008/0284299 | A1 * | 11/2008 | Chen et al. | 312/332 |
| 2009/0160299 | A1 | 6/2009 | Chen et al. | |
| 2009/0195131 | A1 * | 8/2009 | Chi et al. | 312/319.1 |
| 2010/0027923 | A1 | 2/2010 | Bonat | |

FOREIGN PATENT DOCUMENTS

| | | | |
|---|---|---|---|
| DE | 9114787 | U1 | 2/1992 |
| DE | 20311795 | U1 | 11/2004 |
| DE | 202005006724 | U1 | 7/2005 |
| DE | 202005017635 | U1 | 3/2007 |
| DE | 102007008688 | A1 | 8/2008 |
| DE | 202009005433 | U1 | 7/2009 |
| DE | 202008008541 | U1 | 11/2009 |
| DE | 202008016409 | U1 | 4/2010 |
| EP | 0631745 | A | 1/1995 |
| EP | 0631745 | A1 | 1/1995 |
| EP | 1470769 | A1 | 10/2004 |
| WO | 2008119091 | A1 | 10/2008 |

* cited by examiner

PULL-OUT GUIDE FOR DRAWERS

The present application is a 371 of International application PCT/EP2011/054134, filed Mar. 18, 2011, which claims priority of DE 20 2010 008 079.7, filed Jul. 14, 2010, the priority of these applications is hereby claimed and these applications are incorporated herein by reference.

BACKGROUND OF THE INVENTION

The invention relates to a pull-out guide for drawers or the like, comprising a body rail, a drawer rail, and an automatic retraction for retracting the drawer rail into its closed final position, wherein the automatic retraction is fixed to the body rail or drawer rail and has a pivotable coupling element that is guided in a longitudinally displaceable manner and interacts with a catch provided on the respective other rail.

There are conventional pull-out guides for drawers, in which the automatic retraction is arranged horizontally next to the rail guide package. However, this requires additional space next to the rail guide package such that the upstand of the goods holder must be designed with a correspondingly large size in order to also cover the automatic retraction mechanism.

In other conventional pull-out guides, the automatic retraction is disposed between the drawer rail and the body rail, i.e. is integrated in the rail guide package, and the trigger kinematics of the automatic retraction is horizontally triggered. However, this horizontal trigger kinematics is disadvantageous in that the automatic retraction housing must be relatively rigid and often laterally projects past the guide package. In this connection, the goods holder is frequently subjected to a noticeable lateral trigger motion since the triggering force acts in the direction of the weaker area moment of inertia of the guide package. There are also conventional complex automatic retraction housing constructions made from sheet metal, which absorb the generated lateral triggering forces. The coupling mechanics of these solutions also often horizontally projects past the guide package.

Disclosed are also pull-out guides, in which the automatic retraction is arranged in the body rail or drawer rail. In this case, this area cannot be used as a guideway, and for this reason, the automatic retraction in accordance with these solutions can only be arranged in the extension of the rails, in consequence of which longer and more expensive rails must be used. Moreover, in case of arrangement in the body rail, versions with short guides cannot be realized.

SUMMARY OF THE INVENTION

In contrast thereto, it is the object of the present invention to eliminate these disadvantages of a pull-out guide of the above-mentioned type.

This object is achieved in accordance with the invention in that the automatic retraction and the catch are arranged in a vertical intermediate space, which is formed between a horizontal web of the body rail and a horizontal web of the drawer rail, the automatic retraction housing abuts the horizontal web of that rail to which the automatic retraction is fixed, and the coupling element can be pivoted about a horizontal axis into a locked position.

The inventive support of the automatic retraction housing on the horizontal web of the body rail or the drawer rail allows particularly compact and delicate integration of the automatic retraction between the body rail and the drawer rail, since the vertical coupling or decoupling forces which are generated during vertical coupling or decoupling of the coupling element are transferred to the body rail or drawer rail. The load acting on the drawer that can be vertically absorbed by these rails is much larger than the forces that can be absorbed in a horizontal direction. According to the invention, the generated coupling or decoupling forces are vertically absorbed in the direction towards the higher load bearing capacity of the rail guide, where they are introduced into the guide package in an almost unnoticeable manner. Moreover, the vertical play in the guide package is substantially smaller than the horizontal play. The compact construction also permits covering of the guide package with hollow frame/goods holder/drawer to a great depth towards the wall bracket.

The automatic retraction housing advantageously abuts the horizontal web at least in the two final positions of the coupling element for optimum absorption of the coupling or decoupling forces of the coupling element.

In its tensioned pivoted final position, the coupling element preferentially internally abuts that housing wall of the automatic retraction housing which housing wall abuts the outside of the horizontal web.

Further advantages of the invention can be extracted from the description and the drawing. The features mentioned above and below may be used in accordance with the invention either individually or collectively in arbitrary combination. The illustrated and described embodiments are not to be understood as exhaustive enumeration but have exemplary character for describing the invention.

BRIEF DESCRIPTION OF THE DRAWING

The invention is shown in the drawing and is explained in more detail with reference to embodiments. In the drawings.

DETAILED DESCRIPTION OF THE INVENTION

Figure 1:
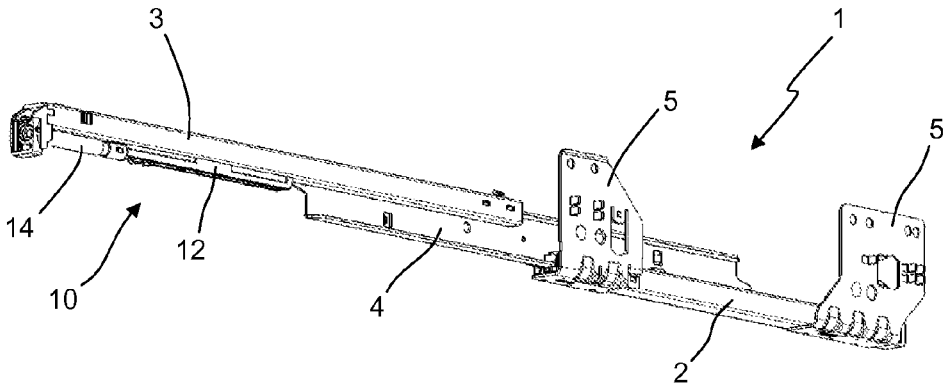
FIG. 1 shows a perspective view of a first embodiment of the inventive pull-out guide for a drawer.

The pull-out guide 1 for a drawer, illustrated in FIG. 1, comprises a body rail 2, a drawer rail 3 and a center rail 4 that runs between these two. The rails 2, 3, 4 are guided via rolling bodies (not shown) in such a manner that they can be displaced relative to each other in a longitudinal direction. The rolling bodies are rotatably supported inside rolling body cages by two rolling body carriages (not shown), of which the lower rolling body carriage is supported in the body rail 2 and the upper rolling body carriage is supported in the drawer rail 3. Two body legs 5 are provided on the body rail 2 for mounting to a furniture body. The overall guide package of rails 2, 3, 4 and guides thereof is designated by 6 in FIG. 2.

An automatic retraction 10, which is integrated in the guide package 6, is mounted to the drawer rail 3 and retracts the drawer rail 3 shortly before it reaches its closed final position in a dampened manner into its final position.

As is illustrated in FIGS. 3 and 4, the automatic retraction 10 comprises a pivotable coupling element 11 which is guided in such a manner that it can be displaced in a longitudinal direction and which interacts with a catcher 13 provided on the body rail 2, as well as a linear damper 14 for dampening the retraction movement.

Figure 2:
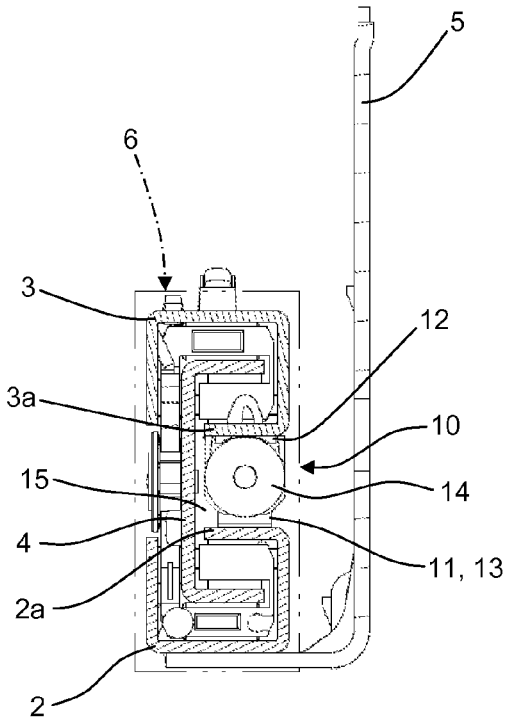
FIG. 2 shows a cross-sectional view through the pull-out guide, illustrated in FIG. 1, in its closed final position.

As is illustrated in FIG. 2, the automatic retraction 10 and the catch 13 are arranged in a vertical intermediate space 15, which is formed between a horizontal web 2*a* of the body rail 2 and a horizontal web 3*a* of the drawer rail 3. The upper housing wall of the automatic retraction housing 12 abuts the lower side of the horizontal web 3*a* of the drawer rail 3 along its entire length, i.e. in particular, along the entire path of displacement of the coupling element 11. The upper side of the linear damper 14 also abuts the lower side of the horizontal web 3*a* of the drawer rail 3.

Figure 3A:
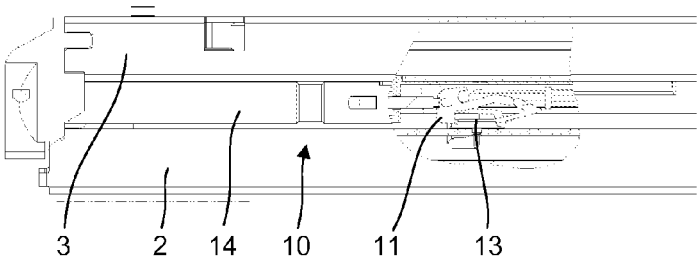
FIGS. 3*a*, 3*b* show a side view (FIG. 3*a*) and a detailed view (FIG. 3*b*) of the pull-out guide, illustrated in FIG. 1, with retracted automatic retraction.
Figure 3B:
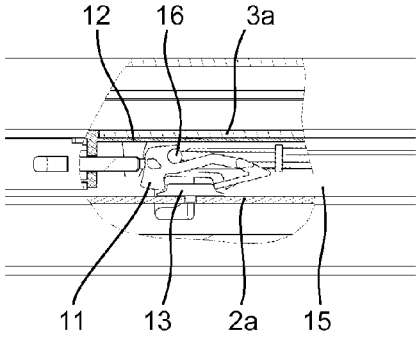
Figure 4A:
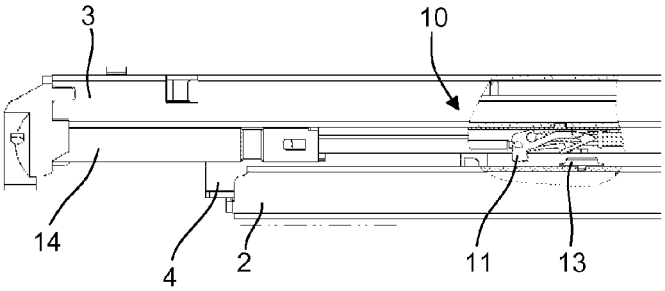
FIGS. 4*a*, 4*b* show a side view (FIG. 4*a*) and a detailed view (FIG. 4*b*) of the pull-out guide, illustrated in FIG. 1, with extended tensioned automatic retraction.
Figure 4B:
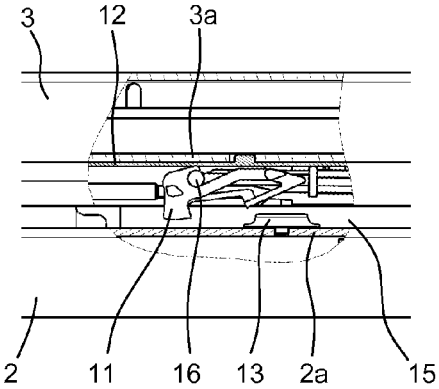

FIGS. 3*a*, 3*b* show the drawer rail 3 in its closed final position with retracted automatic retraction 10, wherein the catch 13 engages with a recess of the hook-shaped coupling element 11. When the drawer rail 3 is pulled out with respect to the body rail 2, the coupling element 11 which is held on the catch 13 is displaced in a longitudinal direction in a straight guideway of the automatic retraction housing 12 against the action of a retracting spring (not shown) until it pivots about a horizontal axis 16 into a locked position at the end of the guideway and is thereby decoupled from the catch 13. The drawer rail 3 with the automatic retraction 10, which is then tensioned, can be freely pulled out to its open final position. In this tensioned pivoted final position, the coupling element 11 internally abuts that housing wall of the automatic retraction housing 12, which wall abuts the outside of the horizontal web 3*a*.

When the drawer rail 3 is being closed, the catch 13 engages again with the recess of the coupling element 11 just before reaching the closed final position, and starts to rotate the coupling element 11 out of its locked position. As soon as the coupling element 11 has returned to the straight guideway, the retracting spring retracts the coupling element 11 held on the catch 13, thereby retracting the drawer rail 3 (FIGS. 4*a*, 4*b*), whereby the drawer rail 3 is moved into the completely retracted position dampened by the linear damper 14.

Since the automatic retraction housing 12 including linear damper 14 abuts the horizontal web 3*a* of the drawer rail 3 and the coupling element 11 also abuts the automatic retraction housing 12 in its tensioned pivoted final position, the vertical coupling or decoupling forces generated by the retracting spring during pivoting of the coupling element 11 are directly transferred to the drawer rail 3. On the one hand, the drawer rail 3 is designed for bearing high vertical loads acting on the drawer, and on the other hand the load acting on the drawer that can be absorbed in a vertical direction by the drawer rail 3 is much larger than the forces that can be absorbed in a horizontal direction. The developed coupling and decoupling forces of the coupling element 11 are absorbed in a vertical direction towards the higher load bearing capacity of the rail guide, where they are transferred into the guide package 6 in a hardly noticeably manner.

Figure 5:
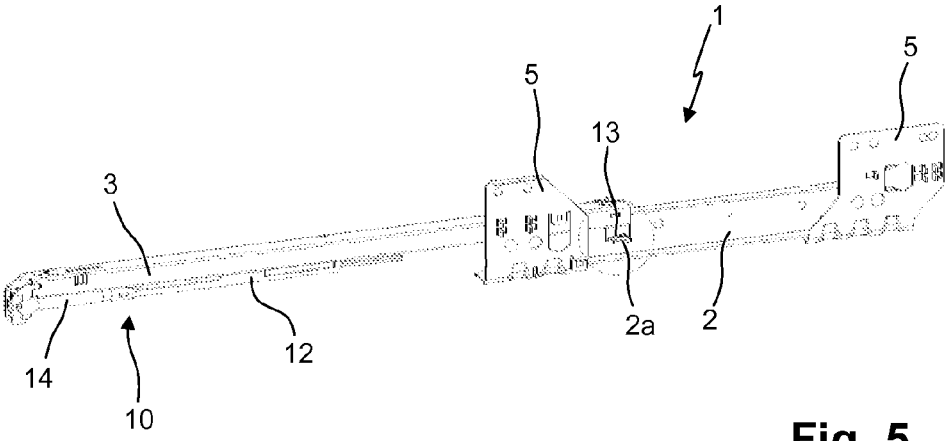
FIG. 5 shows a perspective view of a second embodiment of the inventive pull-out guide for a drawer.
Figure 6:
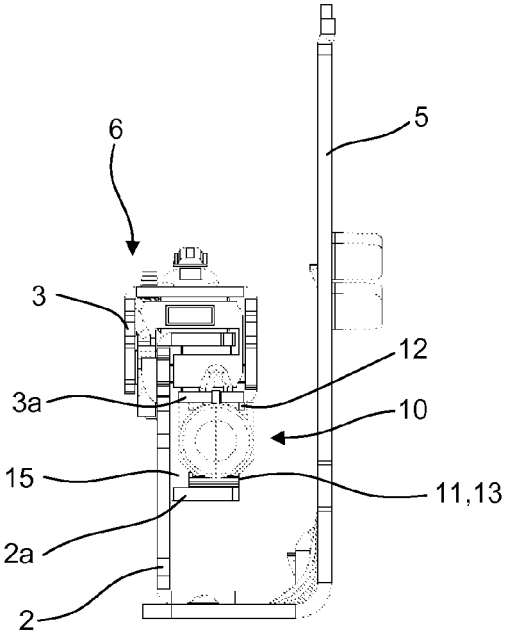
FIG. 6 shows a cross-sectional view through the embodiment, illustrated in FIG. 5, in its closed final position.

Whereas the pull-out guide 1 shown in FIGS. 1 to 4 is designed for completely pulling out the drawer due to its center rail 4, the pull-out guide 1 illustrated in FIGS. 5 and 6, which has no center rail, is merely designed for partially pulling out the drawer. The drawer rail 3 is directly guided in the body rail 2 and the horizontal web 2*a* of the body rail 2 is formed by a bent tab of the body rail 2 to which the catch 13 is mounted.

The invention claimed is:

1. A pull-out guide for drawers, comprising: a body rail; a drawer rail having four webs that form a rectangular cross-section one of said four webs defining a horizontal free-end web with an outwardly facing surface; and an automatic retraction for retracting the drawer rail into a closed final position, wherein the automatic retraction is fixed to the body rail or the drawer rail and has a pivotable coupling element that is guided in a longitudinally displaceable manner and interacts with a catch that is provided on the respective body or drawer rail, wherein the automatic retraction and the catch are arranged in a vertical intermediate space, which is formed between a horizontal free-end web of the body rail and the outwardly facing surface of the horizontal free-end web of the drawer rail, the automatic retraction having a housing that abuts the horizontal free-end web of the body or drawer rail to which the automatic retraction is fixed, and the coupling element is pivotable about a horizontal axis which is perpendicular to the longitudinal displacement direction of the coupling element into a locked position, wherein, in a tensioned pivoted final position, the coupling element internally abuts a housing wall of the automatic retraction housing that in turn abuts an outside of the horizontal free-end web.

2. The pull-out guide according to claim 1, wherein the automatic retraction housing abuts the horizontal free-end web at least in two end positions of the coupling element.

3. The pull-out guide according to claim 1, wherein the automatic retraction housing abuts the horizontal free-end web along an entire path of displacement of the coupling element.

4. The pull-out guide according to claim 1, wherein the automatic retraction housing abuts the horizontal free-end web along an entire length of the automatic retraction housing.

5. The pull-out guide according to claim 1, wherein the automatic retraction has a linear damper that abuts the horizontal free-end web.

6. The pull-out guide according to claim 1, further comprising a center rail provided between the body rail and the drawer rail so as to permit complete pulling out of the drawer.

7. The pull-out guide according to claim 1, wherein the drawer rail and the body rail are directly guided into each other for partially pulling out the drawer.

8. The pull-out guide according to claim 7, wherein the horizontal free-end web of the body rail is formed by a bent tab of the body rail.

* * * * *